US010512324B2

(12) United States Patent
Roundtree

(10) Patent No.: US 10,512,324 B2
(45) Date of Patent: Dec. 24, 2019

(54) SCRUBBING BRUSH HEAD ASSEMBLY

(71) Applicant: Kenneth Roundtree, Houston, TX (US)

(72) Inventor: Kenneth Roundtree, Houston, TX (US)

( * ) Notice: Subject to any disclaimer, the term of this patent is extended or adjusted under 35 U.S.C. 154(b) by 19 days.

(21) Appl. No.: 15/948,745

(22) Filed: Apr. 9, 2018

(65) Prior Publication Data

US 2019/0307238 A1 Oct. 10, 2019

(51) Int. Cl.
*A46B 11/06* (2006.01)
*A46B 11/00* (2006.01)
*A47K 7/06* (2006.01)

(52) U.S. Cl.
CPC ..... *A46B 11/066* (2013.01); *A46B 11/0006* (2013.01); *A46B 11/0037* (2013.01); *A46B 11/06* (2013.01); *A47K 7/06* (2013.01); *A46B 2200/1093* (2013.01)

(58) Field of Classification Search
CPC ..... A46B 11/06; A46B 11/066; A46B 2200/1093; A47K 7/06
USPC ..... 401/289
See application file for complete search history.

(56) References Cited

U.S. PATENT DOCUMENTS 4,236,840 A * 12/1980 Kennedy ..... A01K 13/002 401/270
4,543,913 A 10/1985 Wilkeson
5,109,553 A * 5/1992 Kishimoto ..... A46B 11/06 239/304
D356,442 S 3/1995 Hayes
5,452,961 A * 9/1995 Lu ..... A46B 11/066 401/281
5,649,502 A * 7/1997 Frank ..... A01K 13/001 119/665
6,357,950 B1 * 3/2002 Chih ..... A46B 5/0075 15/50.1
6,718,913 B1 * 4/2004 Stupar ..... A01K 13/002 119/602
8,082,887 B2 12/2011 Fernandez
8,555,819 B1 * 10/2013 McFarland ..... A01K 13/001 119/603
2006/0174842 A1 8/2006 Bond et al.

FOREIGN PATENT DOCUMENTS

WO WO8601073 2/1986

* cited by examiner

*Primary Examiner* — Jennifer C Chiang

(57) ABSTRACT

A scrubbing brush head assembly for cleaning an animal includes a shell. A wall coupled to the shell defines an upper chamber and a lower chamber. A pipe is coupled to the shell and is in fluidic communication with the lower chamber. A connector is configured to couple the pipe to a water source. A valve is configured to control a flow of water. A regulator fluidically couples the upper chamber to the lower chamber and the pipe. Tubes extend from a bottom of the shell and are in fluidic communication with the lower chamber. An actuator selectively actuates the regulator to fluidically couple the upper chamber to the lower chamber and the pipe. The water is partially directed to the upper chamber to dispense shampoo from the upper chamber to the lower chamber. The tubes direct the shampoo and the water to a body of an animal.

13 Claims, 3 Drawing Sheets

SCRUBBING BRUSH HEAD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to brush head assemblies and more particularly pertains to a new brush head assembly for cleaning an animal.

BRIEF SUMMARY OF THE INVENTION

An embodiment of the disclosure meets the needs presented above by generally comprising a shell. A wall coupled to the shell defines an upper chamber and a lower chamber. A pipe is coupled to the shell and is in fluidic communication with the lower chamber. A connector is configured to couple the pipe to a water source. A valve is configured to control a flow of water. A regulator fluidically couples the upper chamber to the lower chamber and the pipe. Tubes extend from a bottom of the shell and are in fluidic communication with the lower chamber. An actuator selectively actuates the regulator to fluidically couple the upper chamber to the lower chamber and the pipe. The water is partially directed to the upper chamber to dispense shampoo from the upper chamber to the lower chamber. The tubes direct the shampoo and the water to a body of an animal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
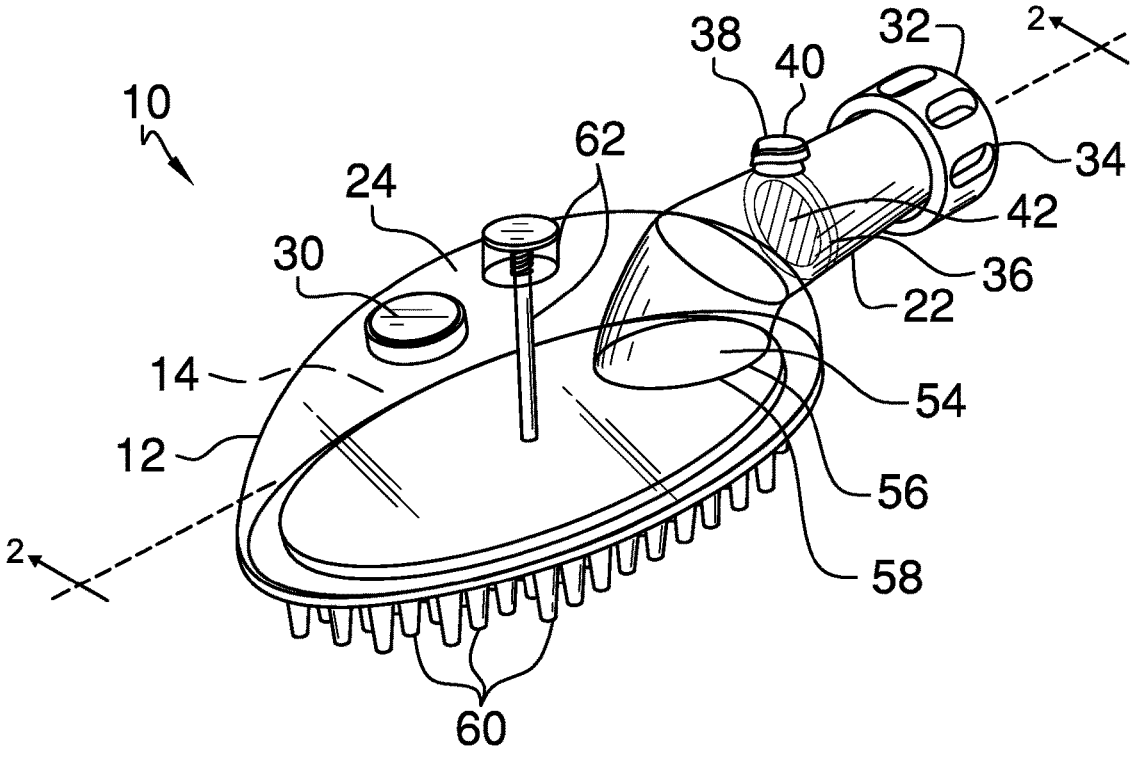
FIG. 1 is an isometric perspective view of a scrubbing brush head assembly according to an embodiment of the disclosure.

With reference now to the drawings, and in particular to FIGS. 1 through 6 thereof, a new brush head assembly embodying the principles and concepts of an embodiment of the disclosure and generally designated by the reference numeral 10 will be described.

As best illustrated in FIGS. 1 through 6, the scrubbing brush head assembly 10 generally comprises a shell 12 that defines an interior space 14. A wall 16 is coupled to the shell 12 and defines an upper chamber 18 and a lower chamber 20 within the interior space 14. The upper chamber 18 is configured to house shampoo. A pipe 22 is coupled to the shell 12 so that the pipe 22 is in fluidic communication with the lower chamber 20.

The shell 12 is substantially ovally shaped when viewed from a top 24 of the shell 12. The top 24 of the shell 12 is arcuate and a bottom 26 is planar so that the shell 12 is substantially half-teardrop shaped. The shell 12, the wall 16, and the pipe 22 are substantially transparent.

Figure 2:
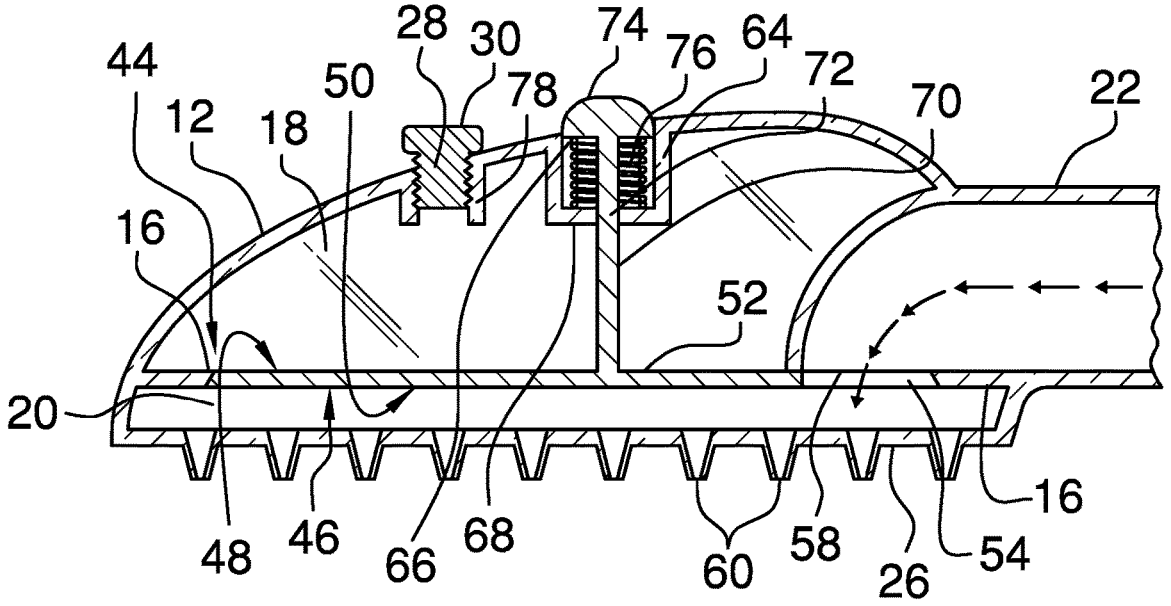
FIG. 2 is a cross-sectional view of an embodiment of the disclosure.

An opening 28 is positioned through the top 24 of the shell 12 so that the opening 28 is configured to add the shampoo to the upper chamber 18. An annular wall 78 is coupled to the shell 12 and extends from the opening 28 into the upper chamber 18, as shown in FIG. 2. The annular wall 78 is internally threaded. A plug 30 that is complementary to the opening 28 is positioned to be threadedly inserted into the annular wall 78 to seal the opening 28.

A connector 32 is coupled to the pipe 22 distal from the shell 12. The connector 32 comprises a hose coupler 34. The connector 32 is configured to couple the pipe 22 to a water source.

A valve 36 is coupled to and is positioned in the pipe 22, as shown in FIG. 1. The valve 36 is configured to control a flow of water from the water source through the pipe 22 to the shell 12. A controller 38 is coupled to and is positioned externally to the pipe 22. The controller 38 is operationally coupled to the valve 36. The controller 38 is positioned to selectively actuate the valve 36 to control the flow of water from the water source through the pipe 22 to the shell 12.

The controller 38 comprises a knob 40 that is rotatable relative to the pipe 22. The knob 40 is configured to be turned to selectively rotate a disc 42 of the valve 36 to control the flow of water from the water source through the pipe 22 to the shell 12.

Figure 3:
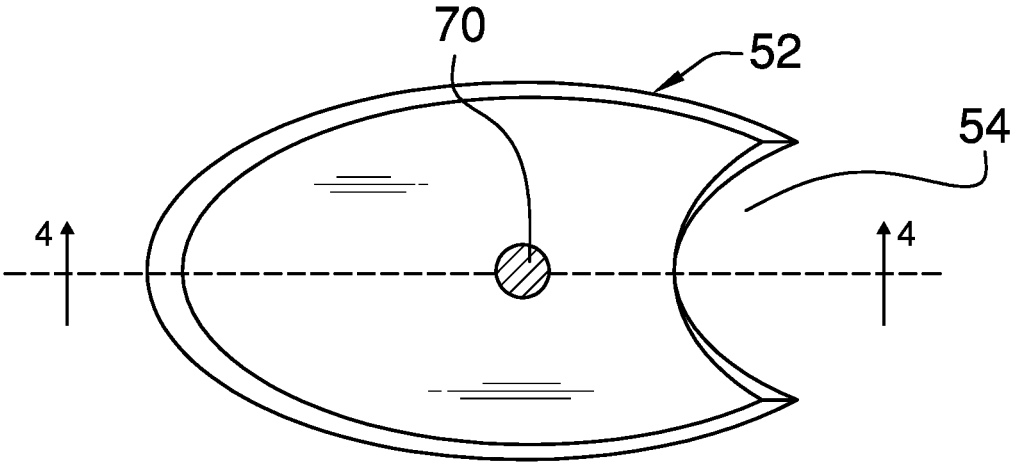
FIG. 3 is a top view of an embodiment of the disclosure.
Figure 4:
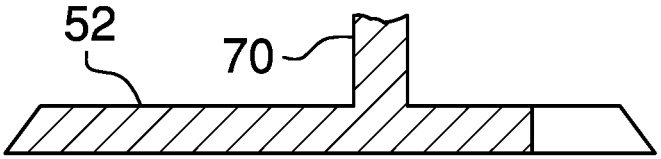
FIG. 4 is a cross-sectional view of an embodiment of the disclosure.

A regulator 44 is positioned in the wall 16. The regulator 44 is positioned to fluidically couple the upper chamber 18 to both the lower chamber 20 and the pipe 22. The regulator 44 comprises an orifice 46 that is positioned in the wall 16 and shown in FIG. 2 being occupied by a plate 52. The orifice 46 has an upper perimeter 48 and a lower perimeter 50. The lower perimeter 50 is larger than the upper perimeter 48, as shown in FIG. 2. The plate 52 is shown in FIG. 2 positioned in the orifice 46 to separate the upper chamber 18 from the lower chamber 20. The plate 52 is substantially transparent. A cutout 54 is positioned in the plate 52, as shown in FIG. 3. A circumference 56 of the cutout 54 is positioned to seat an end 58 of the pipe 22, as shown in FIG. 1.

Figure 5:
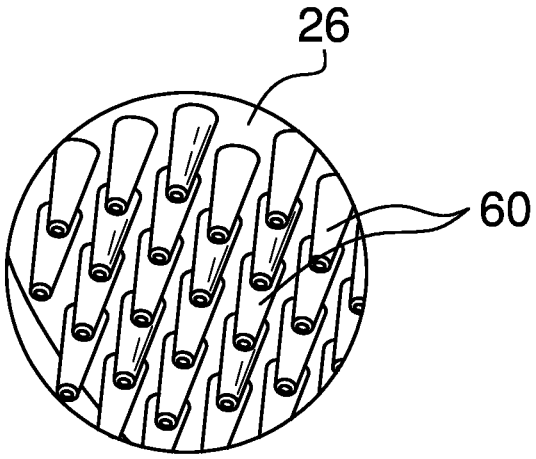
FIG. 5 is an isometric perspective view of an embodiment of the disclosure.
Figure 6:
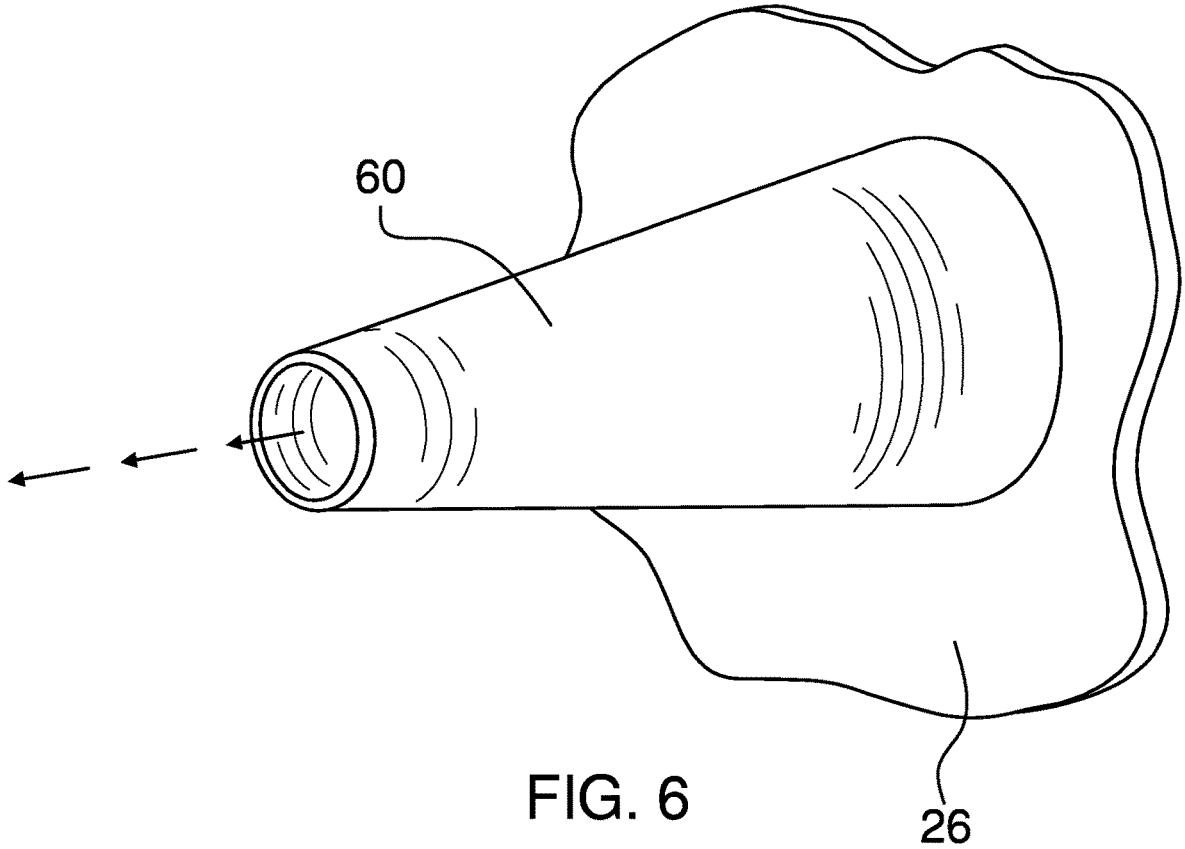
FIG. 6 is an isometric perspective view of an embodiment of the disclosure.

Each of a plurality of tubes 60 is coupled to and extends from the bottom 26 of the shell 12, as shown in FIG. 5. The tubes 60 are in fluidic communication with the lower chamber 20. Each tube 60 is conically shaped, as shown in FIG. 6, so that the tube 60 is circumferentially smaller distally from the bottom 26 of the shell 12.

An actuator 62 is coupled to the shell 12. The actuator 62 is operationally coupled to the regulator 44. The actuator 62 is positioned to selectively actuate the regulator 44 to fluidically couple the upper chamber 18 to both the lower chamber 20 and the pipe 22. The water from the water source is partially directed to the upper chamber 18 to dispense the shampoo to the lower chamber 20. The tubes 60 are configured to direct the shampoo and the water to a body of an animal. The conical shape of the tubes 60 allows the tubes 60 to be inserted through hair of the animal to deliver the shampoo to skin of the animal. Additionally, the tubes 60 act as bristles on a brush for brushing the hair of the animal.

The actuator 62 comprises a cylinder 64 that is coupled by an upper end 66 to the top 24 of the shell 12, as shown in FIG. 2. A lower end 68 of the cylinder 64 is positioned in the upper chamber 18. The cylinder 64 is hollow and the upper end 66 of the cylinder 64 is open. A rod 70 is coupled to and extends perpendicularly from the plate 52 through a rod hole 72 that is positioned through the lower end 68 of the cylinder 64. The rod 70 is substantially centrally positioned on the plate 52. A button 74 is coupled to the rod 70 distal from the plate 52. The button 74 protrudes from the upper end 66 of the cylinder 64 through the top 24 of the shell 12.

A coiled spring 76 is positioned around the rod 70 between the button 74 and the lower end 68 of the cylinder 64, as shown in FIG. 2. The button 74 is configured to be depressed to urge the rod 70 and the plate 52 distally from the top 24 of the shell 12 so that the upper chamber 18 is in fluidic communication with both the pipe 22 and the lower chamber 20. Concurrently, the coiled spring 76 is tensioned. The button 74 is configured to be released, positioning the coiled spring 76 to rebound to urge the rod 70 and the plate 52 proximally to the top 24 of the shell 12 to seat the plate 52 in the orifice 46 to fluidically decouple the upper chamber 18 from the pipe 22 and the lower chamber 20.

In use, the plug 30 is unscrewed from the annular wall 78 and the shampoo is added to the upper chamber 18 through the opening 28. The plug 30 then is threadedly inserted into the annular wall 78 to close the opening 28. The hose coupler 34 is used to couple the pipe 22 to a hose and the knob 40 is turned to selectively rotate the disc of the valve 36 to control the flow of water from the hose through the pipe 22 to the shell 12. The button 74 is selectively depressed so that the water from the hose is partially directed to the upper chamber 18 to dispense the shampoo to the lower chamber 20. The tubes 60 direct the shampoo and the water to the body of the animal. The button 74 is released to seat the plate 52 in the orifice 46 to fluidically decouple the upper chamber 18 from the pipe 22 and the lower chamber 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A scrubbing brush head assembly comprising:

a shell defining an interior space;

a wall coupled to said shell defining an upper chamber and a lower chamber within said interior space wherein said upper chamber is configured for housing shampoo;

a pipe coupled to said shell such that said pipe is in fluidic communication with said lower chamber;

a connector coupled to said pipe distal from said shell wherein said connector is configured for coupling said pipe to a water source;

a valve coupled to and positioned in said pipe wherein said valve is configured for controlling a flow of water from the water source through said pipe to said shell;

a regulator coupled to and positioned in said wall wherein said regulator is positioned for fluidically coupling said upper chamber to said lower chamber and said pipe;

a plurality of tubes, each said tube being coupled to and extending from a bottom of said shell such that said tube is in fluidic communication with said lower chamber; and an actuator coupled to said shell, said actuator being operationally coupled to said regulator wherein said actuator is positioned for selectively actuating said regulator for fluidically coupling said upper chamber to said lower chamber and said pipe wherein the water from the water source is partially directed to said upper chamber for dispensing the shampoo to said lower chamber wherein said tubes are configured for directing the shampoo and the water to a body of an animal.

2. The assembly of claim 1, further including said shell being substantially transparent.

3. The assembly of claim 1, further including said shell being substantially ovally shaped when viewed from a top of said shell, said top of said shell being arcuate, said bottom being planar such that said shell is substantially half-teardrop shaped.

4. The assembly of claim 1, further including said wall being substantially transparent.

5. The assembly of claim 1, further comprising:

an opening positioned through a top of said shell wherein said opening is configured for adding the shampoo to said upper chamber;

an annular wall coupled to said shell and extending from said opening into said upper chamber, said annular wall being internally threaded; and a plug complementary to said opening such that said plug is positioned for threadedly inserting into said annular wall for sealing said opening.

6. The assembly of claim 1, further including said pipe being substantially transparent.

7. The assembly of claim 1, further including said connector comprising a hose coupler.

8. The assembly of claim 1, further including a controller coupled to and positioned externally to said pipe, said controller being operationally coupled to said valve wherein said controller is positioned for selectively actuating said valve for controlling the flow of water from the water source through said pipe to said shell.

9. The assembly of claim 8, further including said controller comprising a knob, said knob being rotatable relative to said pipe such that said knob is configured for turning for selectively rotating a disc of said valve for controlling the flow of water from the water source through said pipe to said shell.

10. The assembly of claim 1, further including each said tube being conically shaped such that said tube is circumferentially smaller distal from said bottom of said shell.

11. The assembly of claim 1, further comprising:

said regulator comprising:

an orifice positioned in said wall, said orifice having an upper perimeter and a lower perimeter, said lower perimeter being larger than said upper perimeter, a plate complementary to said orifice such that said plate is positioned for seating in said orifice for separating said upper chamber from said lower chamber, and a cutout positioned in said plate such that a circumference of said cutout is positioned for seating an end of said pipe;

said actuator comprising:

a cylinder coupled by an upper end to a top of said shell such that a lower end is positioned in said upper chamber, said cylinder being hollow, said upper end being open, a rod coupled to and extending perpendicularly from said plate through a rod hole positioned through said lower end of said cylinder, said rod being substantially centrally positioned on said plate, a button coupled to said rod distal from said plate such that said button protrudes from said upper end of said cylinder through said top of said shell, and a coiled spring positioned around said rod between said button and said lower end of said cylinder, wherein said button is configured for depressing for urging said rod and said plate distally from said top of said shell such that said upper chamber is in fluidic communication with said pipe and said lower chamber, concurrent with tensioning of said coiled spring, wherein said button is configured for releasing positioning said coiled spring for rebounding for urging said rod and said plate proximally to said top of said shell for seating said plate in said orifice for fluidically decoupling said upper chamber from said pipe and said lower chamber.

12. The assembly of claim 1, further including said plate being substantially transparent.

13. A scrubbing brush head assembly comprising: for animals a shell defining an interior space, said shell being substantially transparent, said shell being substantially ovally shaped when viewed from a top of said shell, said top of said shell being arcuate;

a wall coupled to said shell defining an upper chamber and a lower chamber within said interior space wherein said upper chamber is configured for housing shampoo, said wall being substantially transparent;

an opening positioned through said top of said shell wherein said opening is configured for adding the shampoo to said upper chamber;

an annular wall coupled to said shell and extending from said opening into said upper chamber, said annular wall being internally threaded;

a plug complementary to said opening such that said plug is positioned for threadedly inserting into said annular wall for sealing said opening;

a pipe coupled to said shell such that said pipe is in fluidic communication with said lower chamber, said pipe being substantially transparent;

a connector coupled to said pipe distal from said shell wherein said connector is configured for coupling said pipe to a water source, said connector comprising a hose coupler;

a valve coupled to and positioned in said pipe wherein said valve is configured for controlling a flow of water from the water source through said pipe to said shell;

a controller coupled to and positioned externally to said pipe, said controller being operationally coupled to said valve wherein said controller is positioned for selectively actuating said valve for controlling the flow of water from the water source through said pipe to said shell, said controller comprising a knob, said knob being rotatable relative to said pipe such that said knob is configured for turning for selectively rotating a disc of said valve for controlling the flow of water from the water source through said pipe to said shell;

a regulator coupled to and positioned in said wall wherein said regulator is positioned for fluidically coupling said upper chamber to said lower chamber and said pipe, said regulator comprising:

an orifice positioned in said wall, said orifice having an upper perimeter and a lower perimeter, said lower perimeter being larger than said upper perimeter, a plate complementary to said orifice such that said plate is positioned for seating in said orifice for separating said upper chamber from said lower chamber, said plate being substantially transparent, and a cutout positioned in said plate such that a circumference of said cutout is positioned for seating an end of said pipe;

a plurality of tubes, each said tube being coupled to and extending from a bottom of said shell such that said tube is in fluidic communication with said lower chamber, each said tube being conically shaped such that said tube is circumferentially smaller distal from said bottom of said shell, said bottom being planar such that said shell is substantially half-teardrop shaped;

an actuator coupled to said shell, said actuator being operationally coupled to said regulator wherein said actuator is positioned for selectively actuating said regulator for fluidically coupling said upper chamber to said lower chamber and said pipe wherein the water from the water source is partially directed to said upper chamber for dispensing the shampoo to said lower chamber wherein said tubes are configured for directing the shampoo and the water to a body of an animal, said actuator comprising:

a cylinder coupled by an upper end to said top of said shell such that a lower end is positioned in said upper chamber, said cylinder being hollow, said upper end being open, a rod coupled to and extending perpendicularly from said plate through a rod hole positioned through said lower end of said cylinder, said rod being substantially centrally positioned on said plate, a button coupled to said rod distal from said plate such that said button protrudes from said upper end of said cylinder through said top of said shell, and a coiled spring positioned around said rod between said button and said lower end of said cylinder, wherein said button is configured for depressing for urging said rod and said plate distally from said top of said shell such that said upper chamber is in fluidic communication with said pipe and said lower chamber, concurrent with tensioning of said coiled spring, wherein said button is configured for releasing positioning said coiled spring for rebounding for urging said rod and said plate proximally to said top of said shell for seating said plate in said orifice for fluidically decoupling said upper chamber from said pipe and said lower chamber.

* * * * *